US006290732B1

(12) United States Patent
Hei et al.

(10) Patent No.: US 6,290,732 B1
(45) Date of Patent: Sep. 18, 2001

(54) LAUNDRY PROCESS WITH ENHANCED INK SOIL REMOVAL

(75) Inventors: Robert D. P. Hei, Baldwin, WI (US); Kim R. Smith, Woodbury; Wendy Wiseth, St. Paul, both of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/435,933

(22) Filed: Nov. 9, 1999

(51) Int. Cl.[7] ..... D06L 1/02; C11D 3/20; C11D 3/30

(52) U.S. Cl. ..... 8/139.1; 8/137; 510/283; 510/284; 510/336; 510/337; 510/339; 510/340; 510/488; 510/491

(58) Field of Search ..... 510/283, 284, 510/336, 337, 339, 340, 488, 491; 8/137, 139.1

(56) References Cited

U.S. PATENT DOCUMENTS

| | | | | |
|---|---|---|---|---|
| 2,220,099 | | 11/1940 | Guenther et al. | 562/93 |
| 2,477,383 | | 7/1949 | Lewis | 510/418 |
| 3,308,067 | | 3/1967 | Diehl | 510/346 |
| 3,741,902 | | 6/1973 | Barrett, Jr. | 510/283 |
| 3,933,672 | | 1/1976 | Bartolotta et al. | 252/116 |
| 3,936,537 | | 2/1976 | Baskerville, Jr. et al. | 427/242 |
| 4,136,045 | | 1/1979 | Gault et al. | 252/135 |
| 4,144,226 | | 3/1979 | Crutchfield et al. | 528/231 |
| 4,222,905 | | 9/1980 | Crockrell, Jr. | 252/547 |
| 4,228,044 | | 10/1980 | Cambre | 252/547 |
| 4,239,659 | | 12/1980 | Murphy | 252/524 |
| 4,412,934 | | 11/1983 | Chung et al. | 252/186.38 |
| 4,483,781 | | 11/1984 | Hartman | 510/374 |
| 4,634,551 | | 1/1987 | Burns et al. | 252/102 |
| 4,909,953 | | 3/1990 | Sadlowski et al. | 252/99 |
| 5,002,686 | * | 3/1991 | Guth et al. | 252/174.16 |
| 5,104,567 | | 4/1992 | Staehr | 252/174.17 |
| 5,213,705 | | 5/1993 | Olson | 252/95 |
| 5,340,493 | | 8/1994 | Principato | 252/462 |
| 5,340,495 | | 8/1994 | Mulcahy et al. | 252/162 |
| 5,449,474 | | 9/1995 | Lucas et al. | 252/170 |
| 5,536,436 | * | 7/1996 | Pramod | 510/321 |
| 5,637,191 | | 6/1997 | Langley et al. | 162/5 |
| 5,712,234 | | 1/1998 | Pourreau | 510/174 |
| 5,750,484 | * | 5/1998 | Falbaum et al. | 510/276 |
| 5,755,992 | * | 5/1998 | Jeffrey et al. | 252/186.38 |
| 5,820,637 | * | 10/1998 | Bory et al. | 8/137 |
| 5,965,505 | * | 10/1999 | Baillely et al. | 510/311 |
| 6,180,592 | * | 1/2001 | Smith et al. | 510/505 |

FOREIGN PATENT DOCUMENTS

| | | |
|---|---|---|
| 2013051 | 9/1991 | (CA) . |
| 1105375 A | 7/1995 | (CN) . |
| 3147111 A | 6/1983 | (DE) . |
| 4034765 A | 5/1992 | (DE) . |
| 0 157 975 A2 | 10/1985 | (EP) . |
| 0 354 027 A2 | 2/1990 | (EP) . |
| 0 527 315 A2 | 2/1993 | (EP) . |
| 0 755 987 A1 | 1/1997 | (EP) . |
| 2 191 501 A | 12/1987 | (GB) . |
| 58015599 A | 1/1983 | (JP) . |
| 58063800 A | 4/1983 | (JP) . |
| 7126687 A | 5/1995 | (JP) . |
| 7216398 A | 8/1995 | (JP) . |
| 8092598 A | 4/1996 | (JP) . |
| 8283790 A | 10/1996 | (JP) . |
| 8283793 A | 10/1996 | (JP) . |
| 9059682 A | 3/1997 | (JP) . |
| 9194888 A | 7/1997 | (JP) . |
| 9194892 A | 7/1997 | (JP) . |
| 9217097 A | 8/1997 | (JP) . |
| 9272898 A | 10/1997 | (JP) . |
| 10046192 A | 2/1998 | (JP) . |
| 10077426 A | 3/1998 | (JP) . |
| 10152699 A | 6/1998 | (JP) . |
| WO 90/03419 | 4/1990 | (WO) . |
| WO 95/18843 | 7/1995 | (WO) . |
| WO 97/03136 | 1/1997 | (WO) . |

OTHER PUBLICATIONS

Beers, N.C.M. et al., Novel Non–Aromatic Ink Cleaners for the (Offset) Printing Industry, pp. C–101 to C–110, Shell Research B.V., Amsterdam, The Netherlands (English abstract included). (1970) No month available.

* cited by examiner

*Primary Examiner*—Gregory Del Cotto
(74) *Attorney, Agent, or Firm*—Merchant & Gould P.C.

(57) ABSTRACT

An improved process for removing ink soil from porous substrates, preferably from woven fabrics which include cellulosic materials such as cotton towels is described herein. The process includes an initial contacting step with an alkyl fatty acid ester, a wash step with a conventional detergent and a final water rinse step. A chelating agent is used during one of the first two steps or, alternatively, between the first two steps.

19 Claims, No Drawings

LAUNDRY PROCESS WITH ENHANCED INK SOIL REMOVAL

FIELD OF THE INVENTION

The invention relates generally to laundry processes for removing ink soil from porous substrates. More specifically, the invention relates to a process for removing ink soil from woven fabrics such as towels. The invention uses a pre-treatment step containing an alkyl fatty acid ester to improve ink soil removal efficacy.

BACKGROUND OF THE INVENTION

Ink soil removal is a special problem in the laundry industry. Wiper towels and fabric sheeting which have been soiled with ink, i.e. where ink has penetrated the fabric, normally requires use of organic solvents such as mineral spirits, or mixed nonylphenol ethoxylate (NPE) and high caustic. Use of volatile solvents such as mineral spirits leads to fire hazards and contributes to poor air quality in laundry plants.

U.S. Pat. No. 5,340,493 describes a one-step ink-cleaning composition for removing inks from printer hard surfaces, e.g. rollers, metals, rubber surfaces while using woven polyester ink washing blankets which automatically remove ink from such ink transfer rollers and press parts. The composition uses tall oil fatty acid esters and nonionics but requires the use of mineral spirits.

U.S. Pat. No. 5,340,495; WO 95/18843 and EP 527 315 also describe similar one-step ink-cleaning compositions for removing inks from printer blankets as in the above '493 patent. The compositions employ fatty acid methyl esters, nonionic surfactants and possibly glycol solvents and volatile solvents like mineral spirits. No chelants are described in these references.

We have found that by employing a chelant and using an alkyl fatty acid ester in a pre-treatment step, improved ink removal results were found without the need for using volatile organic solvents.

SUMMARY OF THE INVENTION

Accordingly, in its broadest sense, the invention can be found in a process for removing ink soil from porous substrates having the steps of first conditioning the substrate with an alkyl fatty acid ester, cleaning the substrate with a conventional detergent composition, and rinsing the substrate with water; wherein an effective amount of a chelating agent can be added during the conditioning step or the cleaning step or between these steps.

In a preferred embodiment, the invention is found in a laundry process for removing ink soil from a porous textile substrate which has the steps of pre-treating the substrate in a soak cycle containing an alkyl fatty acid ester, treating the substrate in a wash cycle including a conventional detergent composition and an effective amount of a chelating agent, and treating the substrate to one or more water rinse cycles.

In another preferred embodiment, the invention is found in a laundry process for removing ink soil from a porous textile substrate having the steps of pre-treating the substrate in a soak cycle containing an alkyl fatty acid ester and an effective amount of a chelating agent, treating the substrate in a wash cycle including a conventional detergent composition, and treating the substrate to one or more water rinse cycles.

DETAILED DESCRIPTION OF THE INVENTION

The processes described in the invention involve a pre-wash treatment which includes contacting an ink soiled substrate with a composition containing an alkyl fatty acid ester. It has been found that this pretreatment step substantially improves ink soil removal during a subsequent conventional washing step. Addition of the ester directly to the wash liquor has little or no effect.

While the alkyl fatty acid ester must be added to the pretreatment step, no such limitation exists for the chelating agents described in the invention. These chelants can be added to the pretreatment step, to the wash step or in between the two steps. Typically, pretreatment contacting steps are about 5 minutes in length while commercial wash steps are typically about 20 minutes in length.

Such a pretreatment may be either as a pre-spotter or as a pre-detergent flush in the cleaning sequence in a washing machine or as a pre-soak step prior to washing. The pre-treatment serves to condition the soil and makes it more susceptible to mechanical action in a subsequent washing step with traditional detergents.

The alkyl fatty acid ester can be applied to the substrate, i.e. the textile fabric, in the form of a liquid concentrate or in a dilute aqueous dispersion in, e.g., a wash cycle. A liquid concentrate has about 30 to 100 wt-% of an alkyl fatty acid ester while the dilute solution contains about 0.01 to about 5 wt-% of the alkyl fatty acid ester. The liquid concentrate may be applied directly on the substrate by pouring or spraying.

Accordingly, the invention is most broadly found in a process for removing ink soil from porous substrates having the steps of first conditioning the substrate with an alkyl fatty acid ester, cleaning the substrate with a conventional detergent composition, and rinsing the substrate with water; wherein an effective amount of a chelating agent can be added during the conditioning step or the cleaning step or between these steps.

In a preferred embodiment, the invention is found in a laundry process for removing ink soil from a porous textile substrate which has the steps of pre-treating the substrate in a soak cycle containing an alkyl fatty acid ester, treating the substrate in a wash cycle including a conventional detergent composition and an effective amount of a chelating agent, and treating the substrate to one or more water rinse cycles.

In another preferred embodiment, the invention is found in a laundry process for removing ink soil from a porous textile substrate having the steps of pre-treating the substrate in a soak cycle containing an alkyl fatty acid ester and an effective amount of a chelating agent, treating the substrate in a wash cycle including a conventional detergent composition, and treating the substrate to one or more water rinse cycles.

Alkyl Fatty Acid Esters

The process of the invention begins with a pretreatment step with a composition containing an alkyl fatty acid ester. Possible alkyl groups include from $C_1$ to $C_8$ straight or branched hydrocarbon chains, while methyl fatty acid esters are preferred.

The esters can be formed with a variety of fatty acids, including from $C_8$ to $C_{24}$ fatty acids. However, $C_{12}$–$C_{18}$ fatty acids are preferred. Esters can also include mono, di and triglycerides. A preferred ester is available commercially as SOY GOLD®, which is methyl soyate. This is the methyl ester of soybean oil, which consists generally of triglycerides of oleic, linoleic, linolenic and other acids.

Generally, the fatty acid ester is used in an aqueous solution containing from about 0.01 to about 5, preferably about 0.01 to about 2 wt-% of the alkyl fatty acid ester.

Chelating Agents

The processes described in the invention utilize a chelating agent which is included in one of the first two processing steps or between such steps in a separate cycle. Preferred chelating agents include an aminocarboxylic acid, an organic phosphonate, an inorganic phosphonate or a mixture thereof. Preferred chelating agents include ethylenediamine-tetraacetic acid and nitrilotriacetic acid, and their salts.

Chelating agents usefull in the invention also include amino-tris-(methylenephosphonic acid), 1-hydroxyethylidene-1,1-diphosphonic acid, hexarnethylenediamine-tetra-(methylenephosphonic acid), diethylenetriamine-penta-(methylenephosphonic acid), or alkali metal salts thereof. These phosphonates are part of the DEQUEST® series which are available commercially from Monsanto; St. Louis, Miss.

Typically, these chelating agents are used at a concentration of about 0.01 to about 5, preferably about 0.01 to about 2 wt-%.

Conventional Detergent Compositions

The processes of the invention utilize a conventional detergent composition after the initial pretreatment step. Conventional detergent compositions may include an alkalinity source, surfactants, builders or sequestrants and minor ingredients.

Surfactants

Useful anionic surfactants include the water soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS. Also, preferred are mixtures of $C_{10-16}$ (preferably $C_{11-13}$) linear alkylbenzene sulfonates and $C_{12-18}$ (preferably $C_{14-16}$) alkyl sulfates, alkyl ether sulfates, alcohol ethoxylate sulfates, etc.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Also useful are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility and are most preferred in compositions of the present invention.

Examples of suitable synthetic, water soluble anionic compounds are the alkali metal (such as sodium, lithium and potassium) salts or the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl naphthalene sulfonate, dialkyl naphthalene sulfonate and alkoxylated derivatives. Other anionic detergents are the olefin sulfonates, including long chain alkene sulfonates, long chain hydroxyalkane sulfonates or mixtures of alkenesulfonates and hydroxyalkane-sulfonates and alkylpoly (ethyleneoxy) ether sulfonates. Also included are the alkyl sulfates, alkyl poly (ethyleneoxy) ether sulfates and aromatic poly (ethyleneoxy) sulfates such as the sulfates or condensation products of ethylene oxide and nonyl phenol (usually having 1 to 6 oxyethylene groups per molecule).

Nonionic surfactants are also useful in the instant detergent granules. Such nonionic materials include compounds produced by the condensation of alkylene oxide groups (hydrophilic in nature) with an organic hydrophobic group or compound, which may be aromatic, aliphatic or alkyl in nature. The length of the polyoxyalkylene group which is condensed with any particular hydrophobic group can be readily adjusted to yield a compound having the desired degree of balance between hydrophilic and hydrophobic elements.

Included are the water soluble and water dispersible condensation products of aliphatic alcohols containing from 8 to 22 carbon atoms, in either straight chain or branched configuration, with from 3 to 12 moles of ethylene oxide per mole of alcohol. Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkylene oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Useful nonionic surfactants include block polyoxypropylene-polyoxyethylene polymeric compounds based upon propylene glycol, ethylene glycol, glycerol, trimethylolpropane, and ethylenediamnine as the initiator reactive hydrogen compound. Examples of polymeric compounds made from a sequential propoxylation and ethoxylation of initiator are commercially available under the trade name PLURONIC® manufactured by BASF Corp. PLURONIC® compounds are difunctional (two reactive hydrogens) compounds formed by condensing ethylene oxide with a hydrophobic base formed by the addition of propylene oxide to two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. TETRONIC® compounds are tetra-functional block copolymers derived from the sequential additional of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Also useful nonionic surfactants include the condensation products of one mole of alkyl phenol wherein the alkyl constituent, contains from about 8 to about 18 carbon atoms with from about 1 to about 50 moles of ethylene oxide. The alkyl group can, for example, be represented by diisobutylene, di-amyl, polymerized propylene, isoctyl, nonyl, and di-nonyl. Examples of commercial compounds of this chemistry are available on the market under the trade name IGEPAL® manufactured by Rhone-Poulenc and TRITON® manufactured by Union Carbide.

Likewise useful nonionic surfactants include condensation products of one mole of a saturated or unsaturated, straight or branched chain alcohol having from about 6 to about 24 carbon atoms with from about 1 to about 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade name NEODOL® manufactured by Shell Chemical Co. and ALFONIC® manufactured by Vista Chemical Co. A preferred class of nonionic surfactants are nonyl phenol thoxylates, or NPE.

Condensation products of one mole of saturated or unsaturated, straight or branched chain carboxylic acid having from about 8 to about 18 carbon atoms with from about 1 to about 50 moles of ethylene oxide. The acid moiety can consist of mixtures of acids in the above delineated carbon atoms range or it can consist of an acid having a specific number of carbon atoms within the range. Examples of commercial compounds of this chemistry are available on the market under the trade name NOPALCOL® manufactured by Henkel Corporation and LIPOPEG® manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

Tertiary amine oxides corresponding to the general formula:

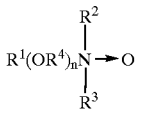

can be used wherein the →bond is a conventional representation of a semi-polar bond; and $R_1$, $R^2$, and $R^3$ may be aliphatic, aromatic, heterocyclic, alicyclic groups or a combination of such groups thereof. Generally, for amine oxides of detergent interest, $R_1$ is an alkyl radical of from about 8 to about 24 carbon atoms; $R^2$ and $R^3$ are selected from the group consisting of alkyl or hydroxyalkyl of 1–3 carbon atoms and mixtures thereof, $R^4$ is an alkylene or a hydroxyalkylene group containing 2 to 3 carbon atoms; and n ranges from 0 to about 20. Useful water soluble amine oxide surfactants are selected from the coconut or tallow dimethyl amine oxides.

Semi-polar nonionic surfactants include amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxylalkyl moieties of from about 1 to 3 carbon atoms. Nonionic surfactants are of the formula $R^1(OC_2H_4)_nOH$, wherein $R^1$ is a $C_6$–$C_{16}$ alkyl group and n is from 3 to about 80 can be used. Condensation products of $C_6$–$C_{15}$ alcohols with from about 5 to about 20 moles of ethylene oxide per mole of alcohol, e.g., $C_{12}$–$C_4$ alcohol condensed with about 6.5 moles of ethylene oxide per mole of alcohol.

Amphoteric surfactants include derivatives of aliphatic or aliphatic derivatives of heterocyclic secondary and tertiary amines in which the aliphatic moiety can be straight chain or branched and wherein one of the aliphatic substituents contain from about 8 to 18 carbon atoms and at least one aliphatic substituent contains an anionic water solubilizing group.

Cationic surfactants can also be included in the present detergent. Cationic surfactants include a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, incorporated herein by reference.

Cationic surfactants are often used in detergent compositions, can provide fabric softening and/or antistatic benefits. Antistatic agents which provide some softening benefit and which are preferred herein are the quaternary ammonium salts described in U.S. Pat. No. 3,936,537, which is incorporated herein by reference.

Useful cationic surfactants also include those described in U.S. Pat. Nos. 4,222,905 and 4,239,659, both incorporated herein by reference.

Alkalinity Source

A source of alkalinity is needed to control the pH of the use detergent solution. The alkalinity source can include an alkali metal hydroxide, such a sodium hydroxide, potassium hydroxide or mixtures thereof; an alkali metal carbonate, such as sodium carbonate, and/or an alkali metal silicate such as sodium metasilicate may also be used. The preferred source, which is the most cost-effective, is commercially available sodium hydroxide which can be obtained in aqueous solutions in a concentration of about 50 wt-% and in a variety of solid forms in varying particle sizes. The sodium hydroxide can be employed in the invention in either liquid or solid form or a mixture of both. Other sources of alkalinity are useful but not limited to the following: alkali metal carbonates, alkali metal bicarbonates, alkali metal sesquicarbonates, alkali metal borates and alkali metal silicate. The carbonate and borate forms are typically used in place of the alkali metal hydroxide when a lower pH is desired.

Other Ingredients

Other ingredients suitable for inclusion in a laundry detergent composition are bleach or other additives. These include detergency builders, suds boosters or suds suppressers, anti-tarnish and anticorrosion agents, soil suspending agents, soil release agents, germicides, pH adjusting agents, smectite clays, enzymes, enzyme-stabilizing agents and perfumes.

Builders (or sequestrants) are employed to sequester hardness ions and to help adjust the pH of the laundering liquor. Such builders can be employed in concentrations up to about 85% by weight, preferably from about 0.5% to about 50% by weight, most preferably from about 10% to about 30% by weight, of the compositions herein to provide their builder and pH-controlling functions. The builders herein include any of the conventional inorganic and organic water soluble builder salts. Such builders can be, for example, water soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates. Nonphosphorus-containing materials can also be selected for use herein as builders.

Specific examples of nonphosphorus, inorganic detergent builder ingredients include water soluble bicarbonate, and silicate salts. the alkali metal, e.g., sodium and potassium, bicarbonates, and silicates are particularly useful herein.

Water soluble, organic builders are also useful herein. For example, the alkali metal, polycarboxylates are useful in the present compositions. Specific examples of the polycarboxylate builder salts include sodium and potassium salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, incorporated herein by reference. Examples of such materials include the water soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization alkaline solution, converted to the corresponding salt, and added to a surfactant.

Bleaching agents and activators useful herein are described in U.S. Pat. No. 4,412,934, U.S. Pat. No. 4,483,781, U.S. Pat. No. 4,634,551, and U.S. Pat. No. 4,909,953, all of which are incorporated herein by reference. Suds modifiers are also optional ingredients and are described in U.S. Pat. Nos. 3,933,672, and 4,136,045, both incorporated herein by reference.

Encapsulate Active Oxidant Bleach

The powdered detergent can include an encapsulated source of active halogen oxidant bleach. Preferred encapsulates are described in Olson, U.S. Pat. No. 5,213,705.

The source of active halogen used in the continuous phase of the solid tablet of the invention and used in the core of the encapsulated source of halogen can be a halogen releasing substance suitable to liberate oxidizing active halogen species such as free elemental halogen (C—, Br—, $Cl_2$, $Br_2$) or —$OCI^-$ or —$OBr^-$, under conditions normally used in detergent bleaching cleaning processes of a variety of cleaning targets. Preferably the halogen releasing compound releases chlorine or bromine species. The most preferred halogen species is chlorine. Chlorine releasing compounds include potassium dichloroisocyanurate, sodium dichloroisocyanurate, chlorinated trisodium phosphate, calcium hypochlorite, lithium hypochlorite, monochloramine, dichloramine, [(monotrichloro)-tetra(monopotassium dichloro)]pentaisocyanurate, 1,3-dichloro-5,5-dimethylidantonone, paratoluene sulfodichloro-amide, trichloromelamine, N-chloramine, N-chlorosuccinimide, N,N'-dichloroazodicarbonamide, N-chloroacetyl-urea, chlorinated dicyandiamide, trichlorocyanuric acid, dichloroglycourea. etc. Chlorinated isocyanurate materials including sodium dichloroisocyanurate dihyrate, sodium dichloroisocyanurate, potassium dichloroisocyanurate, etc. are preferred chlorine sources suitable for the continuous solid phase and for the core substance of the encapsulated material. Chlorinated isocyanurates are commercially available from Monsanto or Olin and other vendors.

Encapsulated chlorine sources of the invention have a chlorine source core and at least one encapsulating layer. The encapsulating layer can be an inorganic material or an organic material or both in a layer or layers. Further, the core chlorine source can be covered with two, three or more useful organic or inorganic layers. Preferably we have found a two layer coating scheme wherein the core is coated with an inner inorganic layer and an outer organic layer consisting of a material (detergent, sequestrant, builder, antiredeposition agent, etc.) useful in washing liquors. For the purposes of this application the term "encapsulating agent", as used herein encompasses solid soluble inorganic compounds used as inert fillers in detergent compositions and soluble inorganic builders used in detergent compositions which contribute to the detergency of the composition and which do not substantially react with a halogen bleach. The external organic phase of the encapsulate can be selected from a variety of encapsulating materials that can be selected from small molecule, monomeric or polymeric sources.

The following examples are intended to illustrate the invention but are not to be construed as limiting the invention.

WORKING EXAMPLE 1

A wash formula test was conducted according to industry standard procedures using commercial 35 lb. laundry equipment. Ink soiled industrial inker towels obtained from a launderer were washed with a variety of wash programs with and without pretreatments. The results were then evaluated for appearance and were subjected to a standard instrumental (Hunter) soil removal determination and a panel evaluation. The panel results reflect the number of panelists who chose a particular towel as the cleanest, relative to the number of people on the panel. For example, a score of 0/10 means that 0 out of 10 panelists picked that particular towel as the cleanest.

Not only do the test results illustrate the benefits of the new composition versus conventional solvent based technology, but they also demonstrate that a pretreatment step is more effective than adding the ester to the wash step.

The results are shown in the following Tables 1 and 2. Sample Nos. 1–5 provide results for standard commercial wash programs and formulations for cleaning ink soils from textile surfaces. Rows 6 and 7 show results using the process and formulations of the present invention.

TABLE 1

| # | Flush[2] | Break[3] | Che-lant[4] | Percent Soil Removal[5] | Panel Test[6] |
|---|---|---|---|---|---|
| Prior Art Wash Formulae[1] | | | | | |
| 1 | none | Turbo Rev ® (16 ox/cwt) Turbo Charge ® (30 oz/cwt) Turbo Speed ® (30 oz/cwt) | NTA and silicate | 10 | 0/10 |
| 3 | NPE blend[7] | Turbo Rev ® (16 ox/cwt) Turbo Charge ® (30 oz/cwt) Turbo Speed ® (30 oz/cwt) | NTA and silicate | 21 | 0/10 |
| Present Invention | | | | | |
| 6 | methyl fatty ester[9] | Turbo Rev ® (16 ox/cwt) Turbo Charge ® (30 oz/cwt) Turbo Speed ® (30 oz/cwt) | NTA and silicate | 45 | 0/10 |

[1]Commercial industrial ink washing formulae using a multi-step wash process of: a 5 minute flush, a 20 minute break, 3 rinses and a centrifugal extraction.
[2]A "Flush" is a standard 5 minute pretreatment sometimes used in wash processes.
[3]A "Break" is the main 20 minute wash step using detergent/builders/alkalinity blends. Three commercial de-inking products were used: Turbo Rev ® , Turbo Charge ® and Turbo Speed ® .
[4]Commercially available metal complexing agents.
[5]Soil removal is defined as 100% times the relative ratio of the [test run Hunter value] divided by the [current art-2 Hunter value].
[6]PaneI Test is a standard 10 person visual evaluation of which test formula gave the best observable performance for all duplicant test pieces.
[7]A commercial nonionic blend of nonylphenol ethoxylates 9.5 and 12, along with a 1-EO nonionic.
[8]Turbo Speed
[9]Soy Gold ®, methyl soyate.

TABLE 2

| # | Flush[2] | Break[3] | Che-lant[4] | Percent Soil Removal[5] | Panel Test[6] |
|---|---|---|---|---|---|
| Prior Art Wash Formulae[1] | | | | | |
| 2 | none | Turbo Rev ® (16 ox/cwt) Turbo Charge ® (30 oz/cwt) Turbo Speed ® (30 oz/cwt) | EDTA and silicate | 55 | 0/10 |
| 4 | NPE blend[7] | Turbo Rev ® (16 ox/cwt) Turbo Charge ® (30 oz/cwt) Turbo Speed ® (30 oz/cwt) | EDTA and silicate | 45 | 0/10 |
| 5 | EDTA and Silicate[8] | Turbo Rev ® (16 ox/cwt) Turbo Charge ® (30 oz/cwt) Turbo Speed ® (30 oz/cwt) | EDTA and silicate | 55 | 0/10 |
| Present Invention | | | | | |
| 7 | methyl fatty ester[9] | Turbo Rev ® (16 ox/cwt) Turbo Charge ® (30 oz/cwt) Turbo Speed ® (30 oz/cwt) | EDTA and silicate | 100 | 10/10 |

[1]Commercial industrial ink washing formulae using a multi-step wash process of: a 5 minute flush, a 20 minute break, 3 rinses and a centrifugal extraction.
[2]A "Flush" is a standard 5 minute pretreatment sometimes used in wash processes.
[3]A "Break" is the main 20 minute wash step using detergent/builders/alkalinity blends. Three commercial de-inking products were used: Turbo Rev ® , Turbo Charge ® and Turbo Speed ® .
[4]Commercially available metal complexing agents.
[5]Soil removal is defined as 100% times the relative ratio of the [test run Hunter value] divided by the [current art-2 Hunter value].
[6]PaneI Test is a standard 10 person visual evaluation of which test formula gave the best observable performance for all duplicant test pieces.
[7]A commercial nonionic blend of nonylphenol ethoxylates 9.5 and 12, along with a 1-EO nonionic.
[8]Turbo Speed
[9]Soy Gold ®, methyl soyate.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A process for removing ink soil from porous substrates comprising:

(a) conditioning said substrate with a $C_1$–$C_8$ alkyl fatty acid ester;

(b) cleaning said substrate with a conventional detergent composition; and (c) rinsing said substrate with water; wherein an effective amount of a chelating agent is added in step (a), step (b) or between steps (a) and (b).

2. The process of claim 1, wherein the alkyl fatty acid is a methyl fatty acid ester.

3. The process of claim 1, wherein the chelating agent is an aminocarboxylic acid or a salt thereof, an organic phosphonate, an inorganic phosphonate or a mixture thereof.

4. The process of claim 1, wherein the chelating agent is ethylenediaminetetraacetic acid, nitrilotriacetic acid, or a salt thereof.

5. The process of claim 1, wherein the chelating agent is amino-tris-(methylenephosphonic acid), 1-hydroxyethylidene-1,1-diphosphonic acid, hexamethylenediamine-tetra-(methylenephosphonic acid), diethylenetriamine-penta-(methylenephosphonic acid), or an alkali metal salt thereof.

6. The process of claim 1, wherein the chelating agent is added as a separate treatment following treatment with the fatty acid ester and prior to the cleaning step.

7. The process of claim 1, wherein the chelating agent is added with the alkyl fatty acid ester.

8. The process of claim 1, wherein the chelating agent is added with the conventional detergent composition.

9. The process of claim 1, wherein the detergent composition comprises surfactants, builders and an alkaline source.

10. A laundry process for removing ink soil from a porous textile substrate comprising:

(a) pre-treating said substrate in a soak cycle comprising a $C_1$–$C_8$ alkyl fatty acid ester;

(b) treating said substrate in a wash cycle comprising a conventional detergent composition and an effective amount of a chelating agent; and (c) treating said substrate to one or more water rinse cycles.

11. A laundry process for removing ink soil from a porous textile substrate comprising:

(a) pre-treating said substrate in a soak cycle comprising a $C_1$–$C_8$ alkyl fatty acid ester and an effective amount of a chelating agent;

(b) treating said substrate in a wash cycle comprising a conventional detergent composition; and (c) treating said substrate to one or more water rinse cycles.

12. A laundry process for removing ink soil from a porous textile substrate comprising:

(a) pre-treating the substrate in an aqueous dispersion comprising from about 0.01 to about 5 wt-% of a $C_1$–$C_8$ alkyl fatty acid ester;

(b) treating the substrate in a wash cycle comprising from about 0.01 to about 2 wt-% of a conventional detergent composition ; and (c) treating the substrate with one or more water rinse cycles;

wherein about 0.01 to about 5 wt-% of a chelating agent is added in step (a), step (b) or between steps (a) and (b).

13. The process of claim 12, wherein the alkyl fatty ester is a methyl fatty acid ester.

14. The process of claim 12, wherein the chelating agent is added with the alkyl fatty acid ester.

15. The process of claim 12, wherein the chelating agent is added with the conventional detergent composition.

16. The process of claim 12, wherein the chelating agent is an aminocarboxylic acid or a salt thereof, an organic phosphonate, an inorganic phosphonate or a mixture thereof.

17. The process of claim 12, wherein the chelating agent is ethylenediarinetetraacetic acid, nitrilotriacetic acid, or a salt thereof.

18. The process of claim 12, wherein the chelating agent is amino-tris-(methylenephosphonic acid), 1-hydroxyethylidene-1,1-diphosphonic acid, hexamethylenediamine-tetra-(methylenephosphonic acid), diethylenetriamine-penta-(methylenephosphonic acid), or an alkali metal salt thereof.

19. The process of claim 12, wherein the detergent composition comprises one or more surfactants, a builder and an alkaline source.

* * * * *

UNITED STATES PATENT AND TRADEMARK OFFICE

CERTIFICATE OF CORRECTION

PATENT NO. : 6,290,732 B1
DATED : September 18, 2001
INVENTOR(S) : Hei et al.

It is certified that error appears in the above-identified patent and that said Letters Patent is hereby corrected as shown below:

Column 6,
Line 21, "$C_{12}$-$C_4$" should read -- $C_{12}$-$C_{14}$ --

Column 11,
Line 1, insert -- acid -- between "fatty" and "ester"
Line 10, "ethylenediarinetetraacetic acid" should read -- ethylenediaminetetraacetic acid --

Signed and Sealed this

First Day of October, 2002

*Attest:*

*Attesting Officer*

JAMES E. ROGAN
*Director of the United States Patent and Trademark Office*